US005572917A

United States Patent [19]

Truemner et al.

[11] Patent Number: 5,572,917

[45] Date of Patent: Nov. 12, 1996

[54] APPARATUS FOR PERFORATING CORRUGATED TUBING AT HIGH SPEEDS AND METHOD OF USING SAME

[76] Inventors: Dale Truemner, 1390 S. Brown Rd., Pigeon, Mich. 48755; Richard Booms, 2581 Sand Beach Rd., Bad Axe, Mich. 48413

[21] Appl. No.: 831,690

[22] Filed: Feb. 5, 1992

[51] Int. Cl.[6] ..... B26D 1/28; B26D 3/14

[52] U.S. Cl. ..... 83/322; 83/591; 83/672

[58] Field of Search ..... 83/54, 340, 672, 83/592, 318, 319, 507, 700, 303, 322, 591

[56] References Cited

U.S. PATENT DOCUMENTS

| | | | |
|---|---|---|---|
| 627,462 | 6/1899 | Legg | 83/340 X |
| 1,510,729 | 10/1924 | Weisner | 83/340 X |
| 2,540,058 | 1/1951 | Stern | 83/340 X |
| 3,370,491 | 2/1968 | Cross | 83/54 X |
| 3,824,886 | 7/1974 | Hegler | 83/329 |
| 3,957,386 | 5/1976 | Lupke | 408/50 |
| 4,158,534 | 6/1979 | Hegler et al. | 83/54 X |
| 4,180,357 | 12/1979 | Lupke et al. | 409/131 |
| 4,218,164 | 8/1980 | Lupke et al. | 409/131 |
| 4,270,878 | 6/1981 | Fales | 409/143 |
| 4,488,467 | 12/1984 | Hegler et al. | 83/303 |
| 4,587,874 | 5/1986 | Lupke et al. | 83/340 |

*Primary Examiner*—Kenneth E. Peterson
*Attorney, Agent, or Firm*—Weintraub, DuRoss & Brady

[57] ABSTRACT

An apparatus for perforating corrugated tubing is disclosed. The apparatus receives tubing to be perforated along an axial path coincident with the axis of the tubing. A plurality of feeder-cutter wheels drive the tubing through the apparatus and concurrently perforate the tubing in the valley of its corrugations. Each feeder-cutter wheel, and the drive shaft each wheel is mounted upon, is offset at an angle relative to the axial path, this angling facilitating uniform perforations at higher speeds. An alternate embodiment of the apparatus has six feeder-cutter wheels disposed within four distinct planes. This design permits the wheels to be interchangeable with different wheels, allowing the apparatus to perforate tubing of different diameters. The alternate embodiment also offsets the wheels at an angle to facilitate perforation at high speeds than previously known in perforating apparatus.

8 Claims, 4 Drawing Sheets

APPARATUS FOR PERFORATING CORRUGATED TUBING AT HIGH SPEEDS AND METHOD OF USING SAME

BACKGROUND OF THE INVENTION

1. Field of the Invention

The present invention concerns an apparatus for perforating corrugated tubing. More particularly, the present invention concerns an apparatus for perforating corrugated tubing at a high rate of speed. Also, the present invention concerns a method for achieving the same.

2. Prior Art

Machines for perforating tubing are known. U.S. Pat. No. 3,824,886, issued Jul. 23, 1974 to Hegler, teaches an apparatus for cutting apertures in corrugated tubing by rotating the cutter circumferentially around the tubing. The cutter is disposed within a ridge on a wheel, which is driven by a transmission. The wheel and cutter cooperate with a roller to rotate about the tubing. The cutter travels in an epitrochoidal path around the outer surface of the tubing, causing a perforation where the cutter strikes the tubing. Hegler achieves perforations perpendicular to the axis of the tubing by this method.

While offering a relatively simple design to achieve its ends, Hegler is necessarily limited to perforating corrugated tubing at relatively low speeds due to the necessity of the wheel with cutter traveling the entire length of the corrugation. Increasing the traveling speed of the wheel beyond modest levels would result in miscuts in the tubing, such as cuts in the side walls of the corrugations instead of the valley thereof. Further, excessive wheel speed would cause the wheel to jump past corrugation, thus missing areas of the tubing and leaving these areas unperforated.

U.S. Pat. No. 4,180,357, issued Dec. 25, 1979 to Lupke et al., teaches an apparatus for perforating tubing. Lupke et al. teaches a machine having a plurality of lead screws for driving the tubing along an axial path, the lead screws having a meshing engagement with the corrugations of the tubing. Each lead screw is mounted on an axis of rotation parallel to the axial path of the tubing. Mounted upon each lead screw is a cutter, flanked on each side by a raised rib. The cutter is in a plane substantially at a right angle to the axial path and the cutter intermittently intersects the tubing. Lupke achieves rotation of the lead screws by a system of gear wheels coordinated such that pairs of lead screws cut the tubing simultaneously. Lupke can achieve a maximum horizontal tubing speed of 20 feet per minute while cutting. At speeds greater than 20 feet per minute, the apparatus of Lupke experiences difficulty in realigning the cutter and properly perforating the tubing.

U.S. Pat. No. 4,218,164, issued Aug. 19, 1980 to Lupke et al., teaches an improvement upon the previous Lupke apparatus. The plurality of lead screw members have mounted thereon a helically raised rib member centrally disposed thereon, the helical rib replacing the raised straight ribs of the previous apparatus. The cutter is disposed at the end of helical rib. The helical rib tends to facilitate entry of the cutter into the valley of the corrugation. The rib of the second Lupke apparatus extends around only a portion of the circumference of the shaft, thus continuing the teaching of intermittent intersection by the cutter as taught in the previous Lupke patent. The second Lupke apparatus achieves a horizontal tubing speed of approximately 40 to 50 feet per minute. At speeds in excess of 50 feet per minute, the second Lupke apparatus tends to climb the side walls of the corrugation and perforate either those walls or the crown of the corrugation.

Lupke et al. overcame the limitation of rotating the entire cutter wheel around the tubing as taught in Hegler. In the first Lupke apparatus the plurality of raised ribs essentially slowed the horizontal movement of the tubing long enough to effect the perforation. The second Lupke apparatus substituted the helical rib for the plurality of straight ribs. This alleviated the need to slow or stop the horizontal travel of the tubing along the axial path to effect the perforation, and works relatively well at lower speeds, i.e. speeds less than 50 feet per minute.

Both Lupke apparatuses encounter serious problems when greater speeds are attempted. When operated at speeds in excess of 50 feet per minute, the cutter in the first Lupke apparatus is not able to spring back to its original start position for the next intermittent engagement of the tubing. Thus, the cutter of Lupke is not able to perforate the valley of the corrugation, but rather cuts into the side wall, miscutting the tubing. Similar problems occur in the second Lupke apparatus.

Additionally, problems are encountered with the feed worms of Lupke. At high speeds, the vertical sides of the feed worms are unable to maintain their helical course in the corrugation. Thus, the worms tend to climb the side walls of the corrugations, crushing the crown of the tubing and skipping parts of the corrugation.

It is therefore the goal of the present invention to overcome the problems heretofore encountered in the prior art. It is a purpose of the present invention to provide an apparatus capable of perforating corrugated tubing at axial speeds in excess of 50 feet per minute, and further to perforate tubing at speeds of 150–200 feet per minute.

It is a further purpose of the present invention to achieve higher axial speeds while providing a simpler design by eliminating the necessity of complicated gear networks to achieve timing relationships.

It is a still further purpose of the present invention to provide an apparatus for perforating tubing of various diameters without the necessity of recalibrating timing relationships or the need for a completely new drive shaft arrangement.

It is to these ends that the present invention is directed.

SUMMARY OF THE INVENTION

The present invention defines an apparatus for cutting perforations in corrugated tubing as the tubing is passed along an axial path thereof, the apparatus comprising:

(a) at least one pair of feeder-cutter wheels, each wheel comprising a worm, a threading disposed upon the worm, and a cutter disposed within the threading, each wheel being adapted to continuously intersect the corrugation of the tubing;

(b) at least one pair of drive shafts, each drive shaft having one wheel axially mounted thereon, the drive shafts being deployed at an angle relative to the axial path of the tubing to apply pressure to the tubing as it is moved past the wheels; and (c) means for rotating the drive shafts;

wherein the feeder-cutter wheels are operable to drive the tubing along the axial path through the apparatus and to cut perforations in the corrugation of the tubing.

The drive shafts of the present invention each comprise a forward portion, a rearward portion and a plurality of U-joints interconnecting the forward portion and the rearward portion and permitting the angling of the feeder-cutter wheel.

Optimally, the feeder-cutter wheel and the drive shaft on which the wheel is mounted upon are deployed at an angle approximately the average of the helical angle of each wheel of the set of feeder-cutter wheels to be disposed on the drive shafts. The set of feeder-cutter wheels is defined as comprising the feeder-cutter wheels which may operatively be mounted upon the drive shafts of a given apparatus for cutting perforations of the present invention, each set of wheels directed to perforating tubing of a different diameter.

The present invention further defines a method for perforating tubing, the method comprising the steps of:

(a) feeding the tubing along an axial path of an apparatus for perforating corrugated tubing, the axial path of the apparatus being coaxial with the axis of the tubing;

(b) intersecting the tubing with a plurality of feeder-cutter wheels, each of the wheels comprising a worm, a spiral threading disposed upon the worm and a cutter disposed within the threading, the wheel mounted upon a drive shaft, the wheel and the drive shaft being disposed at an angle equal to the helical angle of the threading, the angle being relative to the axial path;

(c) driving the tubing along the axial path by rotating the wheels, the tubing being in continuous intersection with the wheels; and (d) perforating the tubing at desired intervals while driving the tubing.

Steps (c) and (d) of the preceding method may be repeated as the length of the tubing is driven through the apparatus.

The present invention will be more clearly understood with reference to the accompanying drawings, in which like reference numerals refer to like parts.

DETAILED DESCRIPTION OF THE PREFERRED EMBODIMENT

Figure 1:
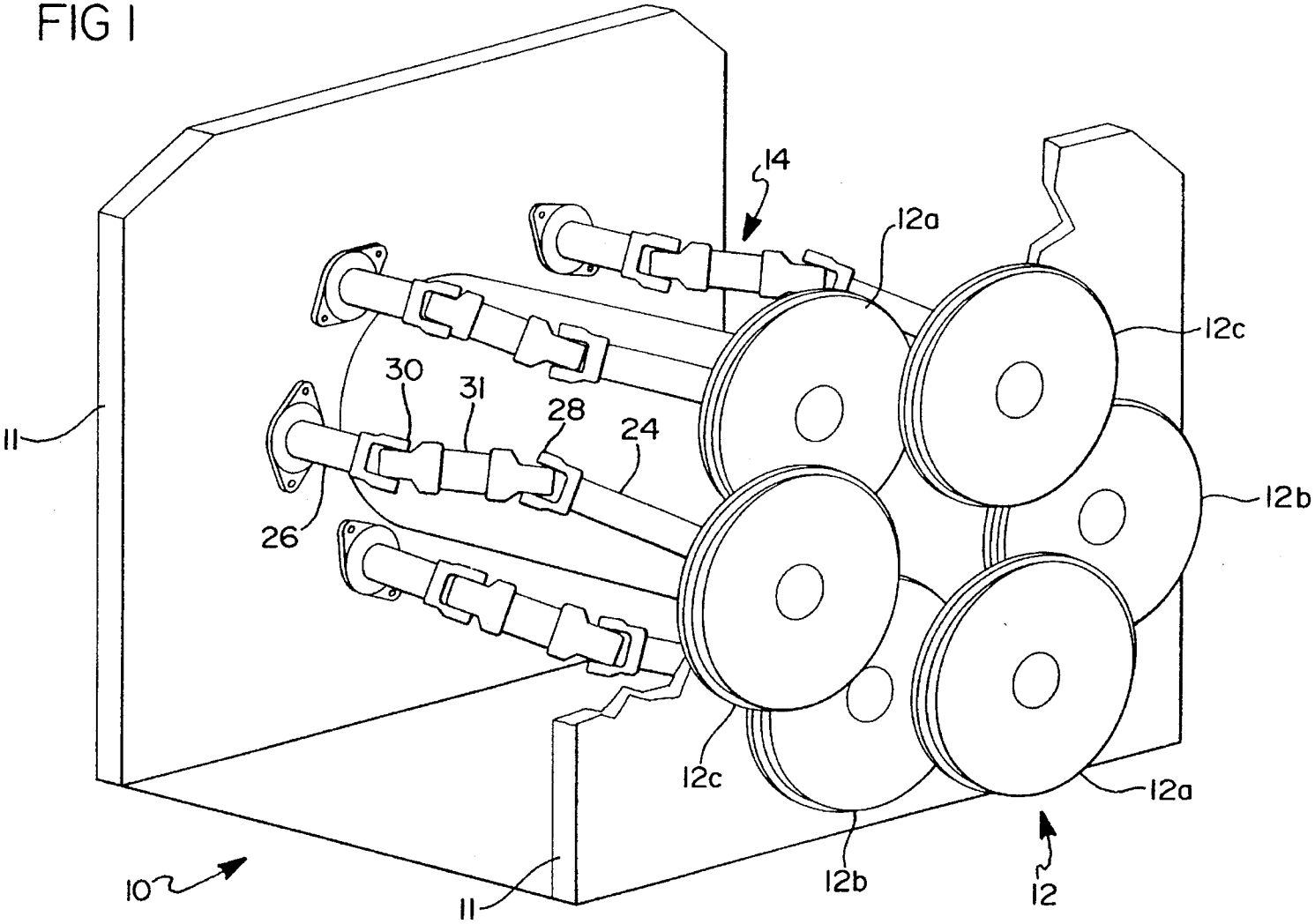
FIG. 1 is a perspective view of a first embodiment of the apparatus for perforating corrugated tubing of the present invention, with a part of the housing cut away.

With reference now to FIGS. 1–4, there is shown therein an apparatus 10 for perforating corrugated tubing in accordance with the present invention. The apparatus 10 comprises a plurality of feeder-cutter wheels 12, a plurality of drive shafts 14, and means 16 for rotating the drive shafts. The apparatus further has a housing 11 for support of items mounted thereon.

The feeder-cutter wheels 12 comprise a worm 18, a rotatable shaft 19, a threading 20 and a cutter 22. The worm 18 comprises a solid cylindrical body, the diameter of which is determined by the size of the tubing T to be perforated. The worm 18 is forwardly joined on the rotatable shaft 19. The threading 20 is disposed helically upon the outer surface of the worm 18. The threading 20 facilitates the intersection and intermeshing of the wheel 12 with the corrugated tubing, indicated at T. The cutter 22 is disposed with the helical threading 20 on the outer surface of the worm 18. The cutter 22 is a hardened and sharpened bit mounted into the worm 18, the cutter 22 having a hook extending slightly above the threading 20. As will be described herein further below, the threading 20 and the cutter 22 of the wheel 12 cooperate to as is concurrently drive the tubing T through the apparatus 10 and perforate the tubing.

The feeder-cutter wheels 12 are larger in size than the cutter wheels previously known in the art. Prior apparatuses, particularly the Lupke machines, utilized relatively small cutters, about 1 to 1.5 inches in diameter. Such prior apparatuses did not teach wheels of varying sizes. The present invention as embodied in the apparatus 10 utilizes wheels larger by a factor ranging from 3 to 6. When it is desired to perforate a tubing T of a larger diameter, a feeder-cutter wheel 12 of a smaller raised diameter is used. Correspondingly, when a smaller tubing T is to be perforated, a feeder-cutter wheel 12 with a larger raised circumference is used.

To achieve utilization of wheels 12 larger than previously known in the art, and to utilize the plurality of pairs of wheels as intended, the wheels 12 are set in different operating planes. The wheels 12 are normally deployed in pairs. Each wheel 12 of the first pair deployed is in a different plane of rotation, denoted here as 12*a*. Each succeeding pair of wheels is then deployed in a different and distinct plane of rotation from the wheels 12*a* of the first pair. Here the second pair are denoted as 12*b* and the third pair as 12*c*. It is to be noted that each wheel 12 of a succeeding pair of wheels deployed rotate in the same plane of rotation. Not only does this deployment of the wheels 12 in different planes achieve the usage of larger wheels 12 and the benefits therein, but also the deployment of wheels in different planes achieves interchangeability of feeder-cutter wheels 12 of different diameters without necessity of changing drive shafts 14 or the calibrations thereof, as will be discussed herein further below.

Figure 3:
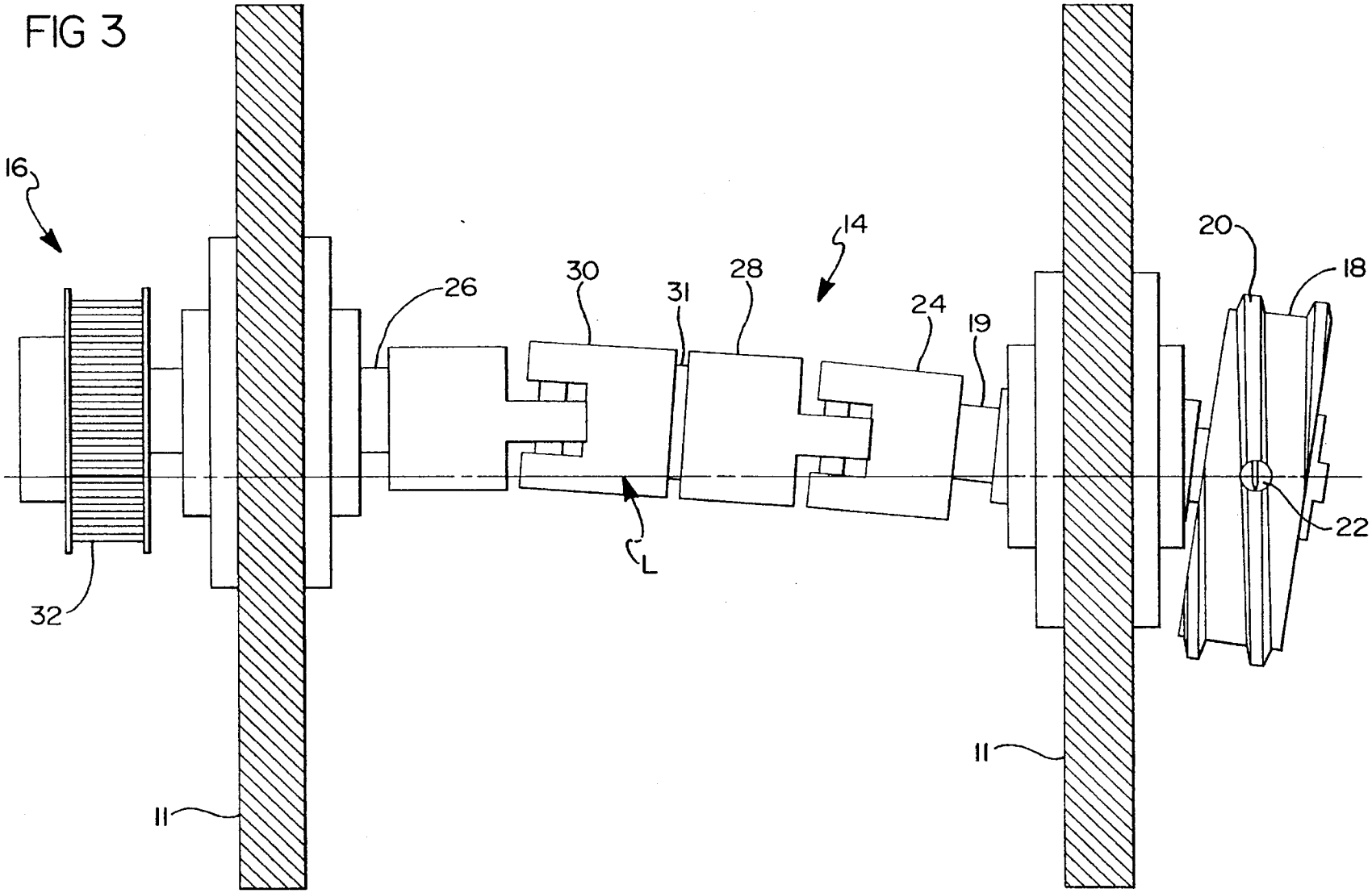
FIG. 3 is a top view of the feeder-cutter wheel and drive shaft of the first embodiment, the drive shaft having U-joints for angling the wheel and shaft.
Figure 4:
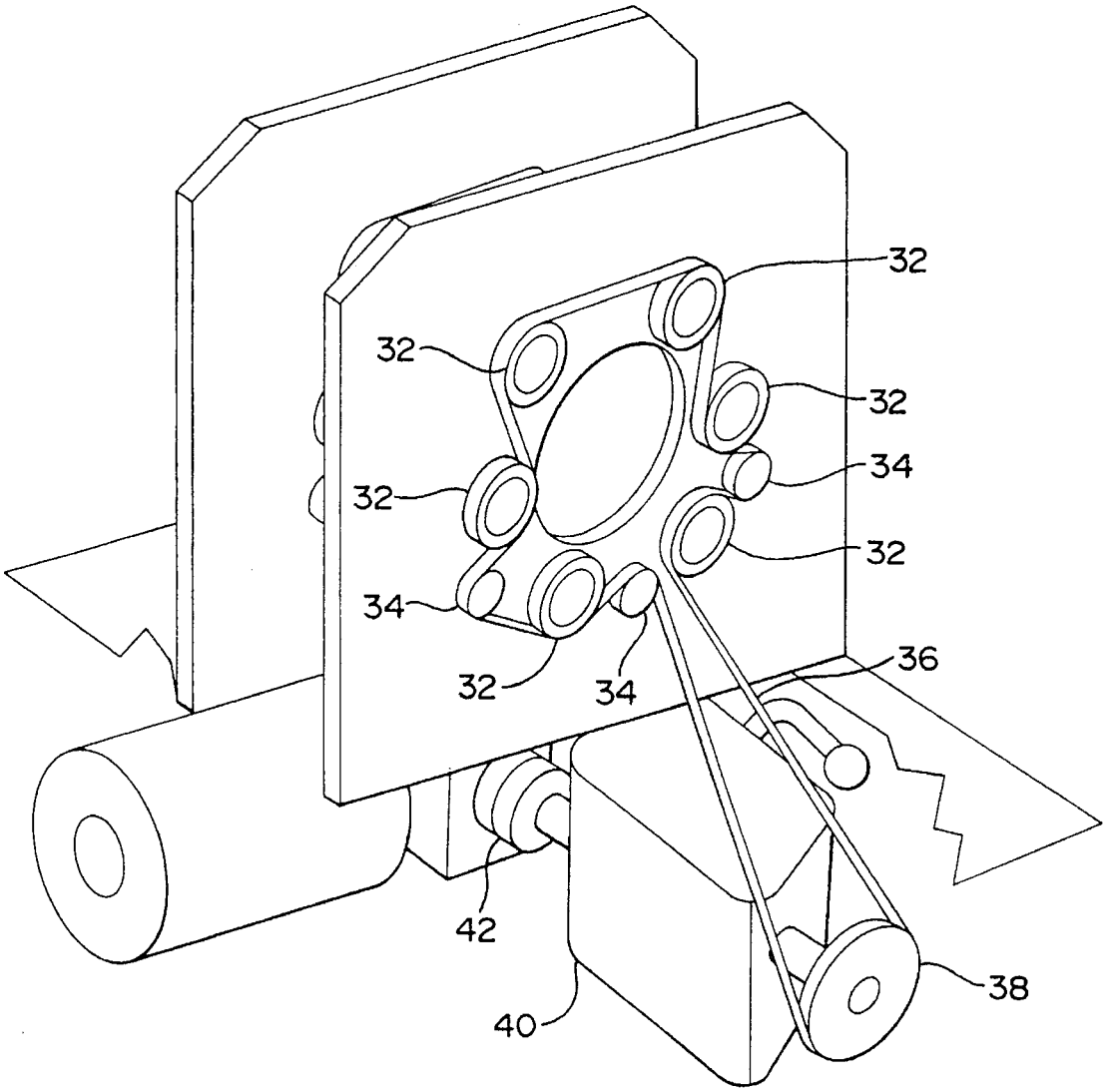
FIG. 4 is a rear view of the apparatus of the present invention, showing three pairs of drive wheels having a belt disposed therearound, the belt connected to means for driving.

Each wheel 12 is mounted upon a corresponding drive shaft 14. The drive shaft 14, in the preferred mode, comprises a forward portion 24, a rearward portion 26 and at least one U-joint 28 interconnecting the forward portion 24 and the rearward portion 26. As shown in FIG. 3, the forward portion 24 receives therein the rearward portion of the rotatable shaft 19, thereby connecting the wheel 12 to the drive shaft 14. The forward portion 24 is then joined to a first U-joint 28. As shown in FIG. 3, the drive shaft 14 has two U-joints. The first U-joint 28 is connected to a second U-joint 30 by an intermediate piece 31. The second U-joint 30 is connected to the rearward portion 26 of the drive shaft 14. The rearward portion 26 is connected to means for driving 18, as described herein further below.

Figure 2:
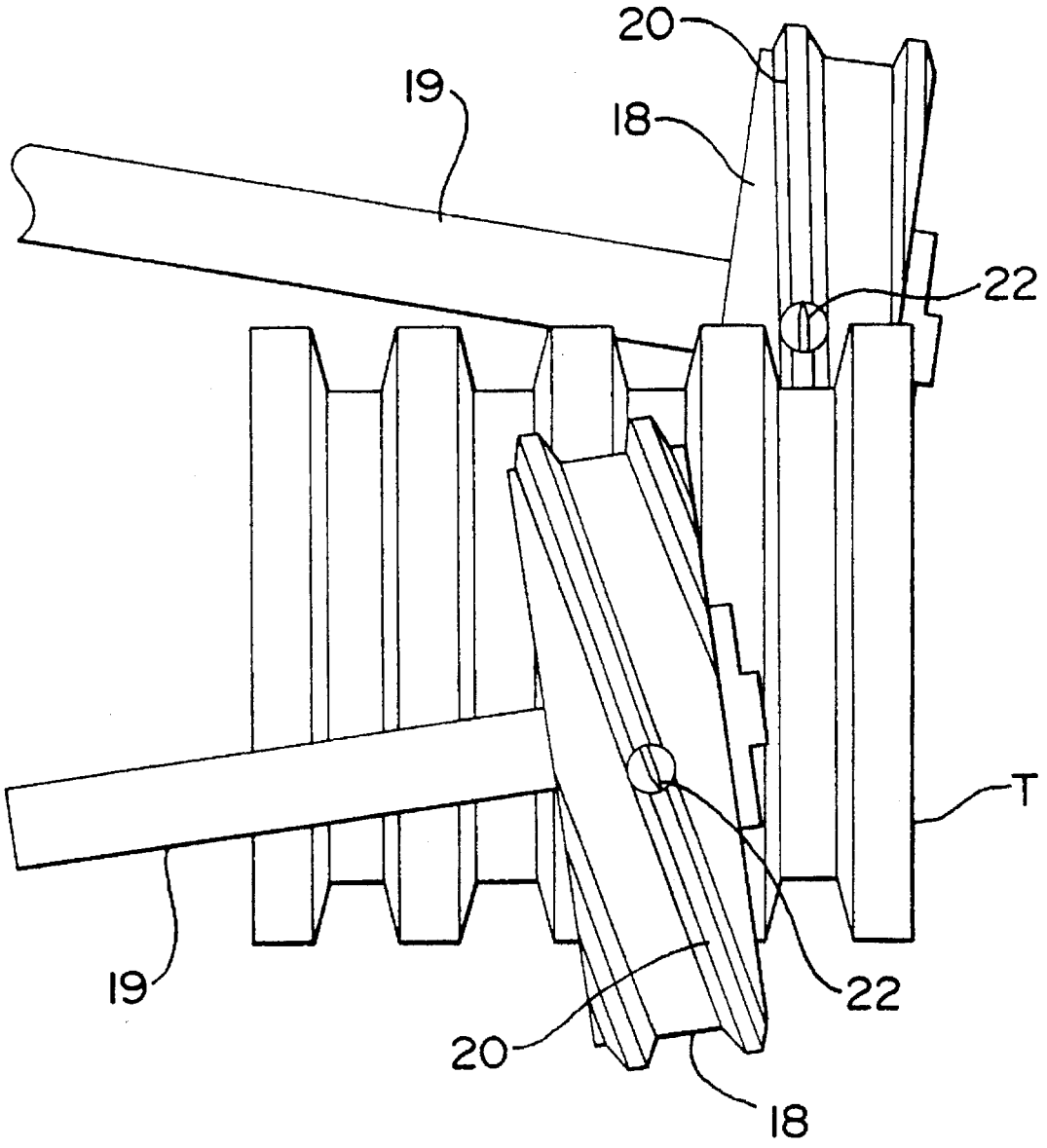
FIG. 2 is a side view of a pair of feeder-cutter wheels and drive shafts of the first embodiment, deployed on a section of corrugated tubing.

The drive shaft 14 and the mounted feeder-cutter wheel 12 are offset at an angle relative to the axial path of the tubing T and the apparatus 10, the axis of the tubing T and the axis of the apparatus 10 being identical or coaxial and shows as L in FIG. 2. To achieve maximum speed in corrugating the tubing T, the drive shaft 14 and corresponding wheel 12 are set at an angle substantially equal to the average of the helical angle of the threading upon each of the feeder-cutter wheels 12 to be deployed on the drive shafts 14 of the apparatus 10. In the typical apparatus 10, it has been found that such an angle supplies sufficient and necessary pressure upon the wheel 12 to keep the threading 20 rotating through the corrugation of the tubing T. This then facilitates the perforation of the tubing T by the cutter 22 in the valley of the corrugation, and not in the side wall or crown of the tubing.

Plastic corrugated tubing, as it is commonly and uniformly manufactured today, has the characteristic of being thickest at the valley of the corrugation and on the crowns of the corrugation. Thus, the side walls of the tubing are comparatively weak due to the manufacturing techniques utilized. Following the principle of seeking the path of least resistance, the known apparatuses for perforating tubing will often, and especially at speeds exceeding 50 feet per minute, miscut the tubing because the cutter cannot slit the thick plastic at the bottom of the corrugation. Thus, the tubing is cut on the side walls, or less commonly, on the crown.

Additionally, it must be noted that the plastic corrugated tubing currently available on the market does not have any helical angle to its corrugations. Tubing with a helical angle was previously known, but none is known to be currently available or in use. The importance of the lack of a helical angle in the tubing relates to the cutting ability of previously known machines and the present invention.

The previous apparatuses known for perforating corrugated tubing, particularly the Hegler machine and the second Lupke apparatus, teach the use of a cutter wheel having a helical rib thereon. But the helical rib, naturally having an angle therein, is incapable of effectively interfacing with corrugated tubing which does not have a corresponding helical angle. This difficulty is particularly acute when the tubing has no angle whatsoever, as in the commonly used and currently available tubing. Previous apparatuses therefore are only in partial contact with tubing while driving the tubing horizontally through an apparatus for perforating. This accounts, to a large extent, for the limitation in driving speed.

The present invention as defined by the apparatus 10 alleviates this problem by offsetting the wheel 12 and the drive shaft 14 by the previously discussed angle. By offsetting the wheel 12 and corresponding drive shaft 14, the threading 20 on each wheel 12 substantially contacts the tubing T along the valley of the corrugations thereon. This facilitates the efficient driving of the tubing T by the apparatus 10 and achieves the significantly increased through-put speeds of up to 200 feet per minute. It also eliminates the problems encountered by previous machines of cutter wheels riding up the ribs of the tubing and miscutting the tubing in either the side walls or the crown of the tubing. Thus, the present invention achieves higher speeds in perforation while eliminating any damage to the tubing during the perforation process.

It has been found that to most efficiently effect the offset angle, at least one U-joint is needed and normally two U-joints 28, 30 are desired. The U-joints 28, 30 allow for the achievement of the offset angle and transmission of rotational power, as is commonly known. One U-joint could, in some circumstances, be used. However, the use of a plurality of U-joints is preferred, as is known in the art.

Referring now again to FIG. 4, the means 18 for rotating the drive shaft are seen comprising a plurality of drive wheels 32, a plurality of sprockets 34 and a belt 36. The drive wheels 32 are individually mounted upon each drive shaft 14 upon the rearward portion 26 thereof. The belt 36 is wound around the drive wheels 32 and the sprockets 34. The sprockets 34 provide tension to keep the belt 36 in tight contact with the drive wheels 32 when in motion. The means 18 for rotating further comprises a transmission 40 in connection with an electric motor 42. The transmission has a drive train connected to a sun sprocket 38 or, alternately, to one of the drive wheels 32. This imparts the necessary energy to allow effective operation of the means 18 for rotating the drive shaft 14 and the wheels 12.

Referring again to FIG. 1, it is noted that the apparatus 10 has three pairs of feeder-cutter wheels, the wheels indicated generally as 12 and in pairs as 12*a*, 12*b* and 12*c*. The design of the apparatus 10 is such that the wheels 12 are disposed in five different planes. Specifically, the worms 18 of the wheels 12 are disposed in distinct planes. A single wheel of the first pair 12*a* is in a first plane. The corresponding wheel of the first pair 12*a* is in a second plane. The wheels of the second pair 12*b* are both deployed in separate plane, but strike the tubing in the same plane. The wheels of the third pair 12*c* are both deployed in a separate plane but strike in the same plane.

The design of spacing the wheels 12 in different different planes, as opposed to one plane, offers a significant advantage over previous apparatuses for perforating tubing. Specifically, the deployment of the wheels 12 in four planes allows for the use of different sized wheels 12 on the same apparatus 10. Thus, one apparatus 10 may perforate tubing of various diameters.

In achieving this versatility, it is to be noted that the present apparatus 10 achieves this without requiring recalibration and resynchronization of the newly mounted wheels 12 and their associated drive shafts. This is due to in part also to the elimination of gears for driving the apparatus. Previously known apparatus required new gear trains when deploying cutter wheels of different sizes. The present invention eliminates this additional cost.

Each pair of wheels is deployed such that the wheels 12*a* of each pair strike the tubing T and cut perforations at the same time. The first pair of wheels 12*a* strike concurrently to cut a first set of perforations. The wheels 12*b* then strike the tubing T to cut a second set of perforations simultaneously and coplanarly. The wheels 12*b*, preferably, strike exactly 120° later than the wheels 12*a*. The wheels 12*c* then strike the tubing T cut a third set of perforations simultaneously and coplanarly, the wheels 12*c* striking 120° of rotation after the wheels 12*b* and 240° of rotation after the wheels 12*a*. The coordination of the wheels 12 produces six uniform lines of perforations along the length of the tubing T.

Alternately, the wheels 12 can have two cutters disposed thereon within the threading 20. The use of two or more threadings can also be used in such a scheme, these multiple helixed wheels being known as multi-start wheels. The use of multiple cutters 20 on the multi-start wheels results in a slower rotation and therefore a slower throughput of the tubing T. The present invention still achieves a speed well in excess of 50 feet per minute and, thus, provides a significant is an improvement over known machines. This cutting of the tubing T can be helped by synchronizing the striking of each pair of cutters thus lessening the load upon the drive equipment.

It is envisioned that the present invention will be capable of accommodating a range of tubing diameters, as desired by the user. Thus, one apparatus may perforate tubing of diameters between 2 inches and 6 inches, while a second machine may perforate tubing over a range of 4 inches to 8 inches in diameter, with various permutations permissible as desired. The present invention eliminates the need of purchasing extra gear works to adapt an apparatus to tubing of different sizes. The additional set-up time needed to synchronize differing sizes of wheels is also saved. The user need only initially synchronize the device and purchase the feeder-cutter wheel sets corresponding to the desired diameters. Tubing of diameters within the range serviceable by a particular apparatus 10 can thus be perforated without an additional expenditure of time otherwise necessary in resetting the machinery or replacing the drive means, such as the gears in previous machines. Savings in time and expenses in additional machine parts are therefore realized.

It is to be noted that the present invention has been described with three pairs of feeder-cutter wheels 12, the present invention can be practiced with two pairs of feeder-cutter wheels operating in three planes. Alternately, additional pairs of wheels operating in separate and distinct planes may be added, as needed or desired.

Although the present invention has been described herein with respect to a specific embodiment thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. An apparatus for perforating corrugated tubing at high speed as the tubing is passed along an axial path thereof, the apparatus comprising:

(a) three pairs of feeder-cutter wheels, the wheels being spaced in four separate planes, each wheel comprising a worm, a threading disposed upon the worm, and a cutter disposed within the threading, each wheel being adapted to continuously intersect the corrugation of the tubing;

(b) six drive shafts, each drive shaft having a wheel mounted thereon, each shaft and corresponding wheel being disposed at an angle relative to the axial path of the tubing to apply pressure to the tubing as it is moved past the wheels; and (c) means for rotating the drive shafts;

wherein the feeder-cutter wheels are operable to drive the tubing along the axial path through the apparatus and to cut the perforation in the corrugation of the tubing.

2. The apparatus of claim 1, further comprising means for simultaneously driving and cutting corrugated tubing of different diameters, the means for cutting and driving comprising a set of feeder-cutter wheels, the set comprising a plurality of groups of six feeder-wheels, each group of wheels having a different diameter and being capable of perforating tubing of different diameters;

wherein each wheel in any group of wheels has threadings of the same helical angle.

3. The apparatus of claim 1, wherein the drive shafts and feeder-cutter wheels mounted thereon are set at an angle substantially equal to the average of the helical angles of the threadings of the groups of wheels.

4. An apparatus for driving corrugated tubing and for cutting perforations in the corrugated tubing as the tubing passes along an axial path in the apparatus, the apparatus comprising:

(a) at least one pair of feeder-cutter wheels, each feeder-cutter wheels being adapted to continuously intersect the corrugation of the tubing and comprising:

(1) a worm;

(2) a helical threading disposed at a helical angle upon the worm to drive the tubing; and (3) at least one cutter disposed within threading to cut the tubing;

(b) at least one pair of drive shafts, each drive shaft having one of the feeder-cutter wheels axially mounted thereon, each of the drive shafts being deployed at an angle relative to the axial path; and (c) means for rotating the drive shafts;

the apparatus having a first pair of feeder-cutter wheels, each wheel of the first pair of feeder-cutter wheels being deployed in a different plane of rotation.

5. The apparatus of claim 4 having at least one successive pair of feeder-cutter wheels, the wheels of any one successive pair of feeder-cutter wheels being deployed to strike the tubing in the same plane.

6. The apparatus of claim 5, wherein each successive pair of feeder-cutter wheels is deployed such that each subsequent pair strikes the tubing in a plane different from the other pairs of feeder-cutter wheels.

7. An apparatus for driving corrugated tubing and for cutting perforations in the corrugated tubing as the tubing passes along an axial path of the apparatus, the apparatus comprising:

(a) at least one pair of feeder cutter wheel, each feeder cutter wheel comprising:

(1) a worm, (2) a helical threading disposed at a helical angle upon the worm to drive the tubing, and (3) at least one cutter disposed within the threading to cut the tubing, each feeder-cutter wheel being adapted to continuously intersect the corrugation of the tubing;

(b) at least one pair of drive shafts, each drive shaft having one of the feeder-cutter wheels axially mounted thereon, each of the drive shafts being deployed at an angle relative to the axial path; and (c) means for rotating the drive shafts;

wherein the feeder-cutter wheels are operable to drive the tubing along an axial path thru the apparatus and to cut the perforations in the corrugation of the tubing;

the apparatus further comprising means for perforating tubing of different diameters without requiring re-calibration or re-alignment of the drive shafts or wheels.

8. The apparatus of claim 7, wherein the means for perforating tubing of varying diameters comprises a plurality of sets of feeder-cutter wheels, each set of wheels having a plurality of wheels of similar diameter, each set of wheels being capable of perforating tubing of a certain diameter, each set of wheels corresponding to tubing of a diameter different from the other sets of wheels; wherein tubing of different diameters can be perforated without re-alignment of the wheels or drive shafts.

* * * * *